US007246758B2

(12) United States Patent
Wang

(10) Patent No.: US 7,246,758 B2
(45) Date of Patent: Jul. 24, 2007

(54) METAL ATOMIZING DEVICE

(76) Inventor: Muh-Rong Wang, 1F-1, No. 88, Section 3, Tsang-Zong Road, Tainan City (TW)

( * ) Notice: Subject to any disclaimer, the term of this patent is extended or adjusted under 35 U.S.C. 154(b) by 0 days.

(21) Appl. No.: 11/342,800

(22) Filed: Jan. 31, 2006

(65) Prior Publication Data

US 2006/0124766 A1 Jun. 15, 2006

Related U.S. Application Data

(62) Division of application No. 10/623,633, filed on Jul. 22, 2003, now Pat. No. 7,137,572.

(51) Int. Cl.

| | |
|---|---|
| ***B05B 1/28*** | (2006.01) |
| ***B05B 1/24*** | (2006.01) |
| ***B05B 7/06*** | (2006.01) |
| ***B05B 7/08*** | (2006.01) |
| ***B22F 9/00*** | (2006.01) |

(52) U.S. Cl. ..... 239/432; 239/124; 239/135; 239/295; 239/426; 239/429; 239/430; 75/331; 75/338; 425/7

(58) Field of Classification Search ..... 239/432, 239/124, 135, 295, 426, 429, 430, 79–82, 239/85, 103, 104, 120, 125, 128, 290, 418, 239/427, 431, 433, 434, 500, 518, 522, 589; 75/331, 338, 337, 339, 10.39, 10.45; 425/7, 425/455, 456

See application file for complete search history.

(56) References Cited

U.S. PATENT DOCUMENTS

| | | | | |
|---|---|---|---|---|
| 3,752,611 | A * | 8/1973 | Reed et al. | 425/7 |
| 4,124,377 | A * | 11/1978 | Larson | 75/337 |
| 4,272,463 | A * | 6/1981 | Clark et al. | 75/337 |
| 4,309,159 | A * | 1/1982 | Holic | 425/7 |
| 4,647,305 | A * | 3/1987 | Kumai et al. | 75/337 |
| 5,196,049 | A * | 3/1993 | Coombs et al. | 75/338 |
| 5,605,560 | A * | 2/1997 | Ono et al. | 75/334 |
| 5,980,604 | A * | 11/1999 | Lavernia | 75/338 |
| 5,993,509 | A * | 11/1999 | Tsao et al. | 75/337 |
| 6,398,125 | B1 * | 6/2002 | Liu et al. | 239/13 |

* cited by examiner

*Primary Examiner*—Kevin Shaver
*Assistant Examiner*—Darren Gorman
(74) *Attorney, Agent, or Firm*—Rosenberg, Klein & Lee

(57) ABSTRACT

A metal atomizing device includes a casing with an inlet tube for providing liquid metal into the casing and an outlet is defined through the casing. The inlet tube and the outlet share a common axis. A polygonal impact member is located at an outlet of the inlet tube and a plurality of gas inlets are connected to the casing so as to provide noble gas into the casing and mixed with the liquid metal that impacts on the impact member. A collection member is located at the outlet of the casing and a pipe communicates with the collection member and the inlet tube so as to send the larger particles into the casing.

7 Claims, 6 Drawing Sheets

METAL ATOMIZING DEVICE

FIELD OF THE INVENTION

This is a divisional patent application for the applicants' former patent application Ser. No. 10/623,633, filed on Jul. 22, 2003 now U.S. Pat. No. 7,137,572.

BACKGROUND OF THE INVENTION

A conventional metal atomizing device generally includes a heater for providing high temperature to the metal, an inlet for ejecting the metal into to a chamber and side nozzle for providing variety of noble gas to mix with the metal in the chamber. The noble gas is expanded in volume by the temperature and the metal is mixed with the noble gas, and the combination of the metal and the noble gas is ejected from a nozzle. Basically, the particles of the metal can be small as 15 μm which is not satisfied in some industries.

The present invention intends to provide a metal atomizing device which provide the particles of metal to 10 to 5 μm.

SUMMARY OF THE INVENTION

In accordance with one aspect of the present invention, there is provided a metal atomizing device which includes a casing having an inlet tube for providing liquid metal into the casing and an outlet which shares a common axis with the inlet tube. A polygonal impact member is located at an outlet of the inlet tube and a plurality of gas inlets are connected to the casing so as to provide noble gas for mixing with the liquid metal. A member is located at the outlet of the casing and a gap is defined between the casing and the collection member. A blowing device is located to blow air into the gap transverse to the common axis. A pipe communicates with the collection member and the inlet tube, a heater connected to the pipe.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIGS. 2 and 2-1 show that the outlet has different shape of opening;

FIGS. 3, 3-1, 3-2, and 3-3 respectively show different shapes of the impact member;

DETAILED DESCRIPTION OF THE PREFERRED EMBODIMENT

Figure 1:
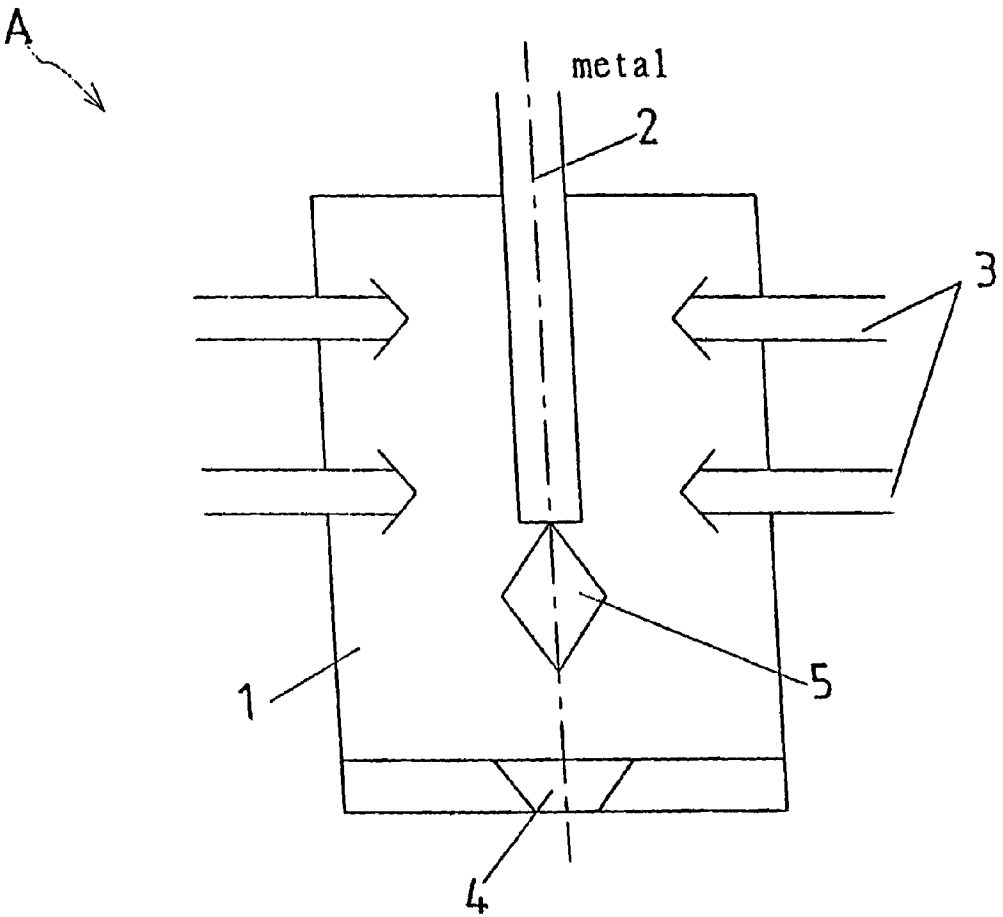
FIG. 1 shows the metal atomizing device of the present invention.
Figures 1, 2:
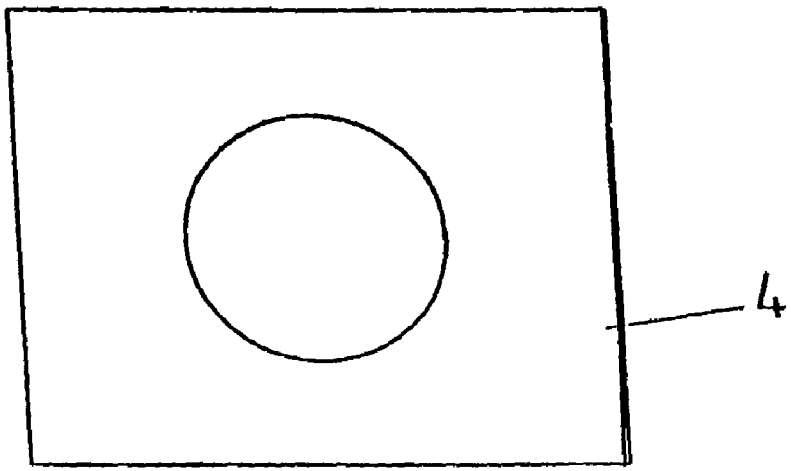
Figure 2:
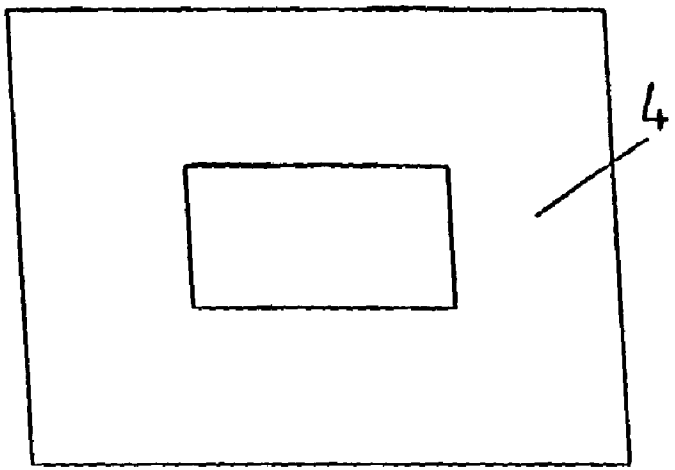
Figure 3:
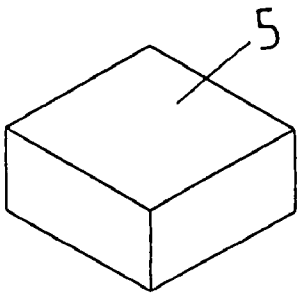
Figures 2, 3:
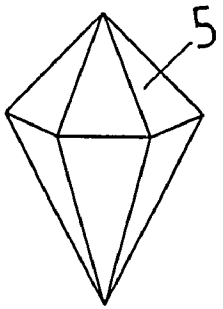
Figures 1, 3:
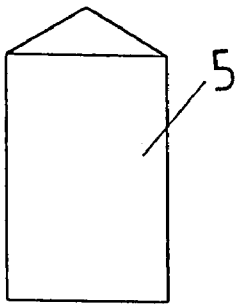
Figure 3:
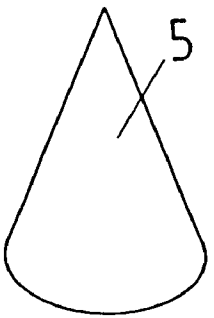
Figure 4:
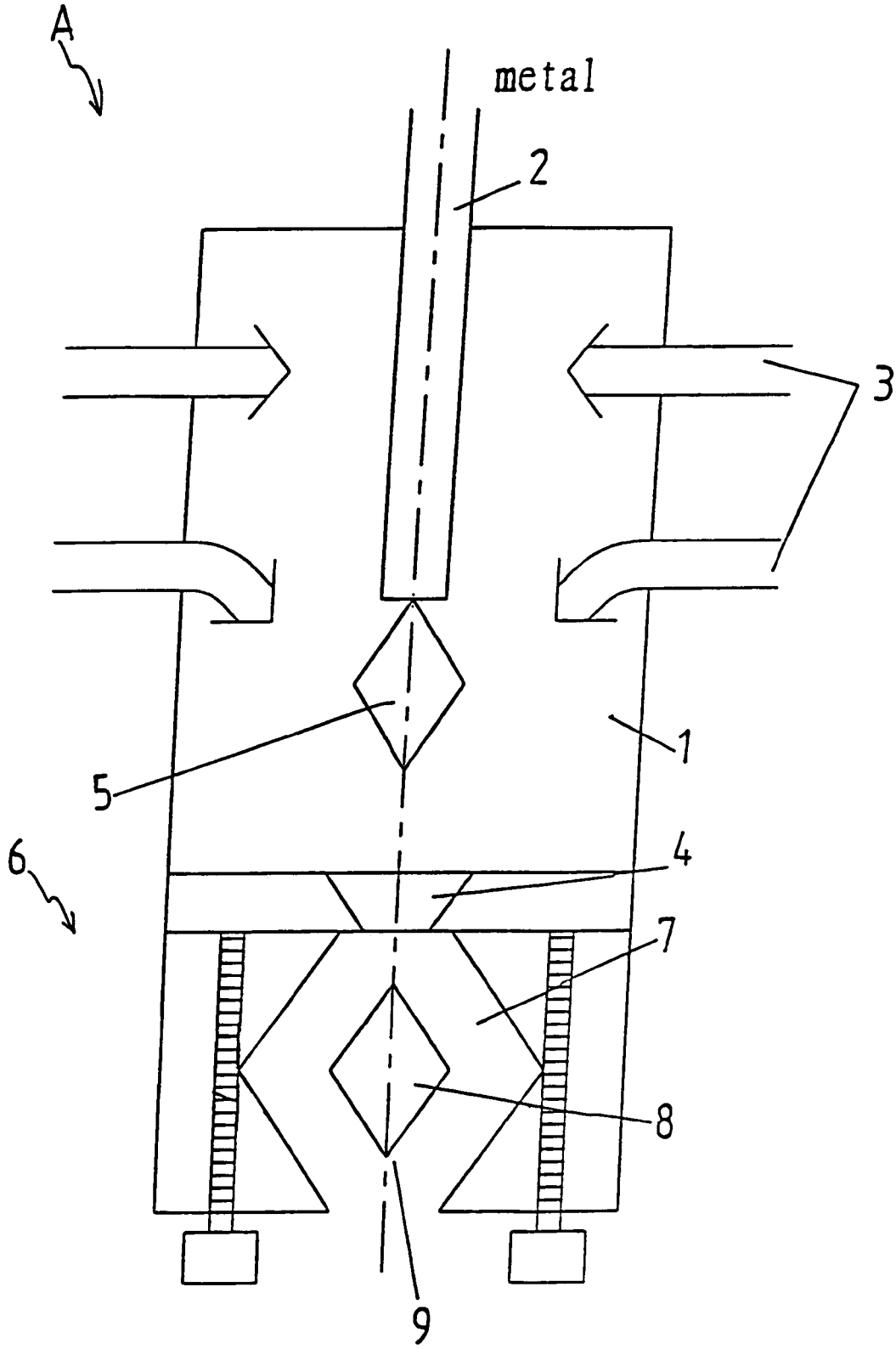
FIG. 4 shows another embodiment of the atomizing device of the present invention.
Figure 5:
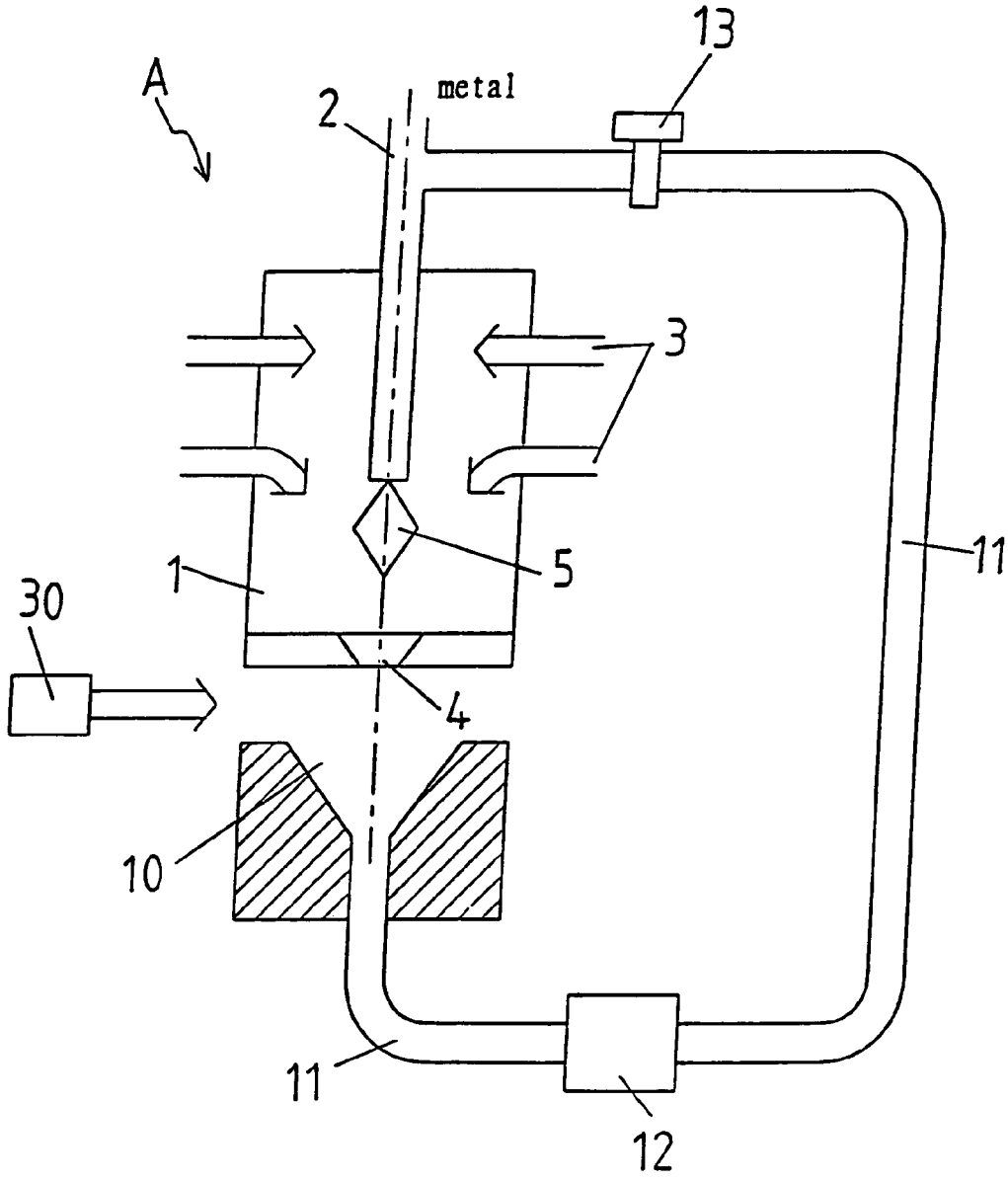
FIG. 5 shows yet another embodiment of the atomizing device of the present invention.
Figure 6:
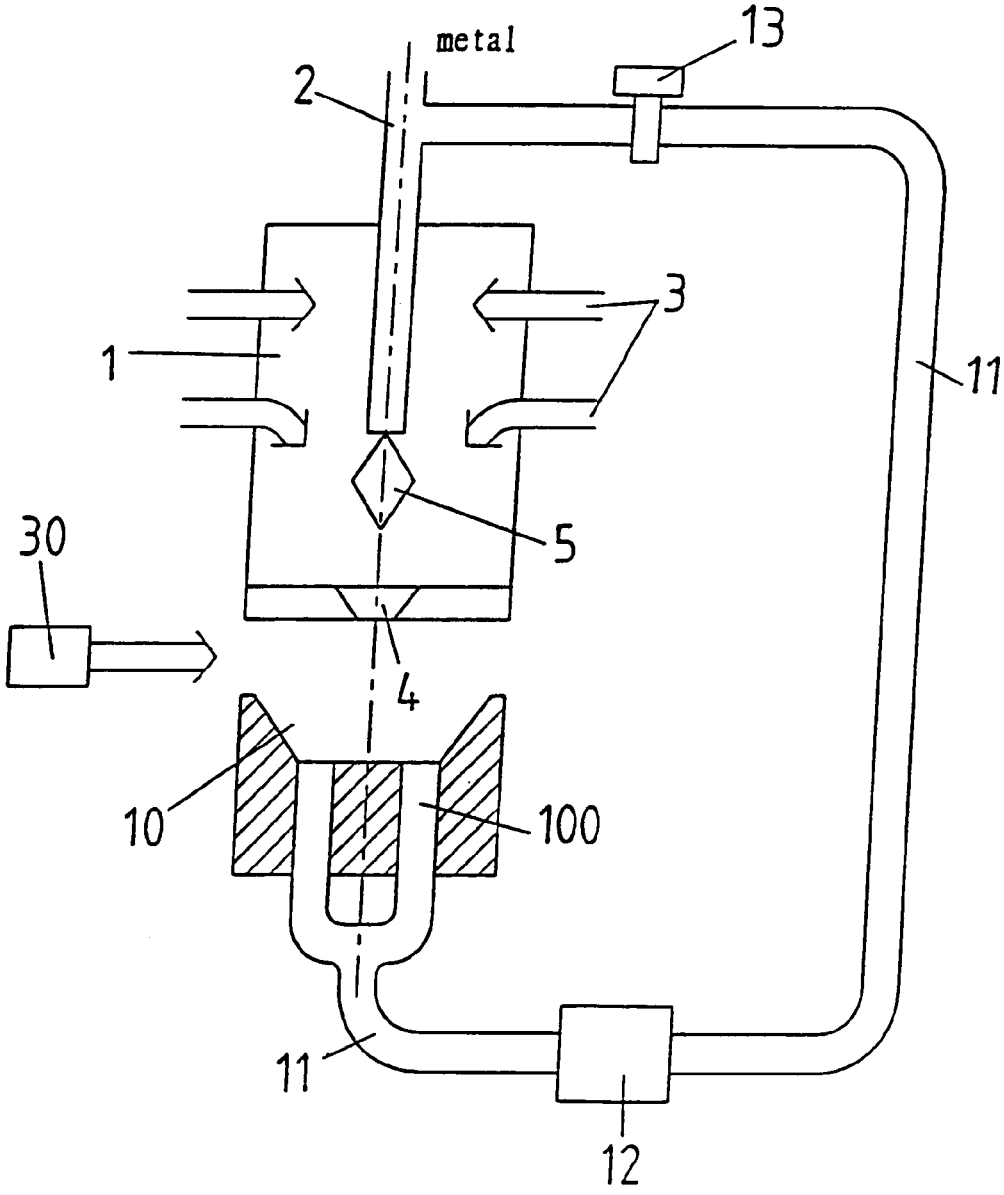
FIG. 6 shows there are two passages in the collection member for the embodiment in FIG. 5.

Referring to FIGS. 4 to 6, the metal atomizing device "A" of the present invention comprises a casing 1 which is an enclosed casing and an inlet tube 2 is inserted in the casing 1 and an outlet 4 is defined through the casing 1, wherein the inlet tube 2 and the outlet 4 share a common axis. A first impact member 5 is located at an outlet of the inlet tube 2 and is a polygonal member, such as a cone-shaped member, a triangular prism member, a polyhedron member or a hexahedron member as shown in FIGS. 3, 3-1, 3-2 and 3-3. A plurality of gas inlets 3 are connected to the casing 1 so as to provide noble gas such as Nitrogen, Helium or Argon into the casing 1.

Metal is heated to be liquid and is provided into the casing 1 via the inlet tube 2 at a certain speed and the liquid metal impacts the first impact member 5 and becomes particles which are mixed with the noble gas in the casing 1. The noble gas is entered into the casing 1 at a certain speed and pressure so that it expands in the casing 1. The mixture of the noble gas and the liquid metal is injected from the outlet 4 which is made to be a funnel shape passage so that the particles are further atomized. The shape of the opening of the funnel-shaped can be a rectangle or triangle as shown in FIGS. 2 and 2-1. The size of the particles is in a range between 20 to 5 μm.

As shown in FIG. 4, the atomizing device can be a two-stage device and includes an extension part 6 connected to the casing 1. The outlet 4 is in communication between the casing 1 and the extension part 6. A second impact member 8 is located in a chamber 7 of the extension part 6 and located on the common axis of the first impact member 5. The chamber 7 includes a plurality of inclined surfaces and an outlet 9 is defined through the extension part 6. By the extension part 6, the size of the particles in a range of 15 to 5 μm are collected via the outlet 9, and the particles between 15 to 20 μm injected from the outlet 4 of the casing 1 impact the second impact member 8 to be further fine particles. After the two-stage atomizing processes, the particles are in a range of 15 to 10 μm.

Referring to FIG. 5 which shows yet another embodiment, wherein a collection member 10 is located at the outlet 4 of the casing 1 and a gap is defined between the casing 1 and the collection member 10. A blowing device 30 is located to blow air into the gap transverse to the common axis so that smaller particles below 15 μm is blown to be collected by a proper collector which is not shown and the particles larger than 15 μm drop into the collection member 10. A pipe 11 communicates with the collection member 10 and the inlet tube 2. A heater 12 and a valve 13 are respectively connected to the pipe 11 so that the larger size particles are re-entered into the casing 1 again. As shown in FIG. 6, the collection member 10 may includes two sub-passages 100 defined therethrough.

While we have shown and described the embodiment in accordance with the present invention, it should be clear to those skilled in the art that further embodiments may be made without departing from the scope of the present invention.

What is claimed is:

1. A metal atomizing device comprising:

a casing with an inlet tube inserted in the casing and an outlet defined through the casing, the inlet tube and the outlet sharing a common axis, an impact member located at an outlet of the inlet tube and being a polygonal member, a plurality of gas inlets connected to the casing so as to be adapted to provide noble gas into the casing, and a collection member located at the outlet of the casing and a gap defined between the casing and the collection member, a blowing device being located to blow air into the gap transverse to the common axis, a pipe communicating with the collection member and the inlet tube, a heater connected to the pipe.

2. The device as claimed in claim 1, wherein the collection member includes two sub-passages defined therethrough and the pipe is connected to a joint outlet of the two sub-passages.

3. The device as claimed in claim 1, wherein the outlet in the casing is a funnel-shaped outlet.

4. The device as claimed in claim 1, wherein the impact member is a cone-shaped member.

5. The device as claimed in claim 1, wherein the impact member is a triangular prism member.

6. The device as claimed in claim 1, wherein the impact member is a polyhedron member.

7. The device as claimed in claim 1, wherein the impact member is a hexahedron member.

* * * * *